US006279865B1

(12) United States Patent
Newman et al.

(10) Patent No.: US 6,279,865 B1
(45) Date of Patent: Aug. 28, 2001

(54) MOUNTING DEVICE

(75) Inventors: William R. Newman; Herb F. Velazquez, both of Neenah, WI (US); Cherry A. Bochmann, Cleveland, OH (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/302,356

(22) Filed: Apr. 30, 1999

(51) Int. Cl.[7] ..... F16M 13/00; B65H 16/02; B65H 18/02; B65H 49/38; B65H 75/00

(52) U.S. Cl. ..... 248/544; 242/595

(58) Field of Search ..... 248/544; 242/595, 242/590, 598.3, 598.6, 599.1, 599.3

(56) References Cited

U.S. PATENT DOCUMENTS

| | | |
|---|---|---|
| Re. 35,976 | 12/1998 | Gasparrini et al. . |
| D. 303,890 | 10/1989 | Pilot . |
| D. 311,106 | 10/1990 | Jaber . |

(List continued on next page.)

FOREIGN PATENT DOCUMENTS

| | | |
|---|---|---|
| 0 122 809 A1 | 10/1984 | (EP) . |
| 0 501 905 A1 | 9/1992 | (EP) . |
| WO 96/21388 A1 | 7/1996 | (WO) . |
| WO 98/08763 A1 | 3/1998 | (WO) . |
| WO 99/06311 A2 | 2/1999 | (WO) . |

OTHER PUBLICATIONS

Derwent World Patent Database abstract of DE 3133237: Description of M. Scheepe, "Refill Pack of Moisture–Impregnated Tissues."

Derwent World Patent Database abstract of JP 07–284,461 A: Description of Kusunoki N (KUSU–I), "Toilet Paper Holder," and Patent Abstracts of Japan JP 07–284,461: Description of Kusunoki Nobuaki, "Toilet Paper–Holder Allowing Taking Out Paper Thereof With One Hand."

(List continued on next page.)

*Primary Examiner*—Ramon O. Ramirez
*Assistant Examiner*—J. DeLuca
(74) *Attorney, Agent, or Firm*—Gregory E. Croft; Michael J. Bendel

(57) ABSTRACT

A mounting device suitable for use with a conventional bathroom tissue fixture. The mounting device may be used to support a dispenser from a conventional bathroom tissue fixture. In some embodiments, the mounting device includes a positioning member, a first support member, a second support member and a linkage operatively disposed between at least one of the support members and the positioning member whereby movement of the positioning member causes relative motion between the distal ends of the first and second support members. Latching mechanisms may also be used with the invention to inhibit the relative motion of the first and second support members. The mounting device may also include a housing and an attachment mechanism, such as a threaded fastener for attaching a dispenser to the mounting device. The housing may also have a longitudinal dimension and be configured whereby the lateral axis defined by the support members is asymmetrically located with respect to the longitudinal dimension of the housing. The attachment mechanism may also be adapted to attach the mounting device to a dispenser in two different positions whereby the lateral axis has a different relative position with respect to the dispenser in the two different positions. The housing may also include a longitudinally extending engagement surface which is engageable with the dispenser and facilitates the alignment of the mounting device and the dispenser.

30 Claims, 8 Drawing Sheets

U.S. PATENT DOCUMENTS

| | | | | |
|---|---|---|---|---|
| D. 329,978 | | 10/1992 | Ryan . | |
| D. 342,635 | | 12/1993 | Carter et al. . | |
| D. 342,852 | | 1/1994 | Welch . | |
| D. 362,773 | | 10/1995 | Kartchner . | |
| D. 381,851 | | 8/1997 | Sharpe . | |
| D. 386,025 | | 11/1997 | Mervar et al. . | |
| D. 387,590 | | 12/1997 | Cameron et al. . | |
| D. 397,265 | | 8/1998 | Badillo . | |
| D. 412,439 | | 8/1999 | Cormack . | |
| D. 416,794 | | 11/1999 | Cormack . | |
| D. 417,109 | | 11/1999 | Johnson et al. . | |
| D. 417,987 | | 12/1999 | Velazquez . | |
| D. 421,691 | | 3/2000 | Hoblitz . | |
| 1,664,392 | | 4/1928 | Baruch . | |
| 2,440,974 | | 5/1948 | Resch . | |
| 3,310,353 | | 3/1967 | Cordis . | |
| 3,368,522 | | 2/1968 | Cordis . | |
| 3,532,210 | | 10/1970 | Minion et al. . | |
| 3,568,635 | | 3/1971 | Poitras et al. . | |
| 3,592,161 | | 7/1971 | Hoffmann . | |
| 3,713,170 | | 1/1973 | Kaufman . | |
| 3,729,145 | | 4/1973 | Koo et al. . | |
| 3,756,483 | | 9/1973 | Schraeder . | |
| 3,775,801 | | 12/1973 | Walker . | |
| 3,780,908 | | 12/1973 | Fitzpatrick et al. . | |
| 3,784,055 | | 1/1974 | Anderson . | |
| 3,795,355 | | 3/1974 | Gerstein . | |
| 3,836,044 | | 9/1974 | Tilp et al. . | |
| 3,836,045 | | 9/1974 | Duhy et al. . | |
| 3,837,595 | | 9/1974 | Boone . | |
| 3,841,466 | | 10/1974 | Hoffman et al. . | |
| 3,843,017 | | 10/1974 | Harrison . | |
| 3,848,822 | | 11/1974 | Boone . | |
| 3,890,622 | | 6/1975 | Alden . | |
| 3,913,522 | | 10/1975 | Light . | |
| 3,949,947 | | 4/1976 | Youngquist et al. . | |
| 3,967,756 | | 7/1976 | Barish . | |
| 3,970,215 | | 7/1976 | McLaren et al. . | |
| 3,982,659 | | 9/1976 | Ross . | |
| 3,986,479 | | 10/1976 | Bonk . | |
| 3,994,417 | | 11/1976 | Boedecker . | |
| 3,995,582 | | 12/1976 | Douglas . | |
| 4,002,264 | | 1/1977 | Marchesani . | |
| 4,004,687 | | 1/1977 | Boone . | |
| 4,043,519 | | 8/1977 | Suzuki et al. . | |
| 4,069,789 | | 1/1978 | Fukagawa et al. . | |
| 4,101,026 | | 7/1978 | Bonk . | |
| 4,106,433 | | 8/1978 | Fernando et al. . | |
| 4,106,616 | | 8/1978 | Boone . | |
| 4,106,617 | | 8/1978 | Boone . | |
| 4,135,199 | | 1/1979 | Kurland et al. . | |
| 4,138,034 | | 2/1979 | McCarthy . | |
| 4,191,317 | | 3/1980 | Harkins . | |
| 4,205,802 | * | 6/1980 | Economakis | 242/55.3 |
| 4,222,621 | * | 9/1980 | Greenlee et al. | 312/37 |
| 4,235,333 | | 11/1980 | Boone . | |
| 4,274,573 | | 6/1981 | Finkelstein . | |
| 4,401,248 | | 8/1983 | Helms . | |
| 4,411,374 | | 10/1983 | Hotchkiss . | |
| 4,427,159 | * | 1/1984 | Miller et al. | 242/55.3 |
| 4,436,221 | | 3/1984 | Margulies . | |
| 4,453,634 | | 6/1984 | Blumenthal . | |
| 4,467,974 | | 8/1984 | Crim . | |
| 4,526,291 | | 7/1985 | Margulies . | |
| 4,535,912 | | 8/1985 | Bonk . | |
| 4,566,606 | | 1/1986 | Kling . | |
| 4,570,820 | | 2/1986 | Murphy . | |
| 4,662,576 | | 5/1987 | Paul . | |
| 4,690,345 | | 9/1987 | Cotey . | |
| 4,735,317 | | 4/1988 | Sussman et al. . | |
| 4,784,290 | | 11/1988 | Howard . | |
| 4,830,301 | | 5/1989 | Miller . | |
| 4,834,316 | | 5/1989 | DeLorean . | |
| 4,860,893 | | 8/1989 | Kaufman . | |
| 4,877,133 | | 10/1989 | Klenter et al. . | |
| 4,883,197 | | 11/1989 | Sanchez et al. . | |
| 4,884,690 | | 12/1989 | Klenter et al. . | |
| 4,936,452 | | 6/1990 | Pauley . | |
| 4,984,530 | | 1/1991 | Dutton . | |
| 4,991,538 | | 2/1991 | Davids et al. . | |
| 5,050,737 | | 9/1991 | Joslyn et al. . | |
| 5,104,054 | | 4/1992 | Latham . | |
| 5,145,091 | | 9/1992 | Meyers . | |
| 5,170,958 | | 12/1992 | Brown . | |
| 5,192,044 | | 3/1993 | Baskin . | |
| 5,193,759 | | 3/1993 | Bigelow et al. . | |
| 5,195,689 | | 3/1993 | Beer et al. . | |
| 5,207,367 | | 5/1993 | Dunn et al. . | |
| 5,219,092 | | 6/1993 | Morand . | |
| 5,228,632 | | 7/1993 | Addison et al. . | |
| 5,253,818 | | 10/1993 | Craddock . | |
| 5,277,375 | | 1/1994 | Dearwester . | |
| 5,310,262 | | 5/1994 | Robison et al. . | |
| 5,311,986 | | 5/1994 | Putz . | |
| 5,335,811 | | 8/1994 | Morand . | |
| 5,368,157 | | 11/1994 | Gasparrini et al. . | |
| 5,392,945 | | 2/1995 | Syrek . | |
| 5,409,181 | | 4/1995 | Patrick . | |
| 5,439,521 | | 8/1995 | Rao . | |
| 5,509,593 | | 4/1996 | Bloch et al. . | |
| 5,533,621 | | 7/1996 | Schoal, Jr. . | |
| 5,542,568 | | 8/1996 | Julius . | |
| 5,598,987 | | 2/1997 | Wachowicz . | |
| 5,618,008 | | 4/1997 | Dearwester et al. . | |
| 5,630,526 | | 5/1997 | Moody . | |
| 5,630,563 | | 5/1997 | Meisner et al. . | |
| 5,642,810 | | 7/1997 | Warner et al. . | |
| 5,649,676 | | 7/1997 | Lord . | |
| 5,653,403 | | 8/1997 | Ritchey . | |
| 5,655,661 | | 8/1997 | Rigby . | |
| 5,660,313 | | 8/1997 | Newbold . | |
| 5,660,636 | | 8/1997 | Shangold et al. . | |
| 5,667,092 | | 9/1997 | Julius et al. . | |
| 5,697,577 | | 12/1997 | Ogden . | |
| 5,704,566 | | 1/1998 | Schutz et al. . | |
| 5,765,717 | | 6/1998 | Gottselig . | |
| 5,848,762 | | 12/1998 | Reinheimer et al. . | |
| 5,868,275 | | 2/1999 | Moody . | |
| 5,897,074 | * | 4/1999 | Marino | 242/594.1 |
| 5,904,316 | | 5/1999 | Dunning et al. . | |
| 5,938,013 | | 8/1999 | Palumbo et al. . | |
| 5,950,960 | | 9/1999 | Marino . | |
| 5,951,762 | | 9/1999 | Shangold et al. . | |
| 6,047,920 | | 4/2000 | Dearwester et al. . | |
| 6,056,233 | * | 5/2000 | Von Shenck | 242/594.5 |
| 6,056,235 | | 5/2000 | Brozinsky . | |
| 6,059,882 | | 5/2000 | Steinhardt et al. . | |
| 6,092,758 | | 7/2000 | Gemmell . | |
| 6,092,759 | | 7/2000 | Gemmell et al. . | |
| 6,098,836 | | 8/2000 | Gottselig . | |

OTHER PUBLICATIONS

Derwent World Patent Database abstract of JP 00–085,782 A: Description of Pigeon KK (PIGE–N), "Paper Holder For Wet Tissues Used in Toilets," and Patent Abstracts of Japan JP 00–085,782: Description of Watanabe Kuniko et al., "Paper Holder."

* cited by examiner

MOUNTING DEVICE

BACKGROUND OF THE INVENTION

The present invention relates to tissue and wipe dispensers and, more specifically, to mounting devices for securing a dispenser to a conventional bathroom tissue fixture.

Conventional bathroom tissue fixtures generally include a telescoping roll bar which engages a pair of oppositely disposed recesses. Conventional roll bars may be used to rotatably support a roll of dry bathroom tissue in a well known manner. Conventional fixtures may include a pair of posts which may be mounted to a wall and extend outwardly therefrom with recesses for the roll bar located near the distal ends of the posts. Conventional fixtures may also be recessed into a wall or cabinet, having a partially cylindrical surface extending inwardly into the wall or cabinet and defining a space in which a portion of the dry tissue roll will be located during use. The pair of oppositely disposed recesses for receiving the roll bar of such recessed fixtures may also be recessed whereby the roll bar is located at or inward of the wall or cabinet panel surface. The recesses may also be located on relatively short posts which extend partially outward whereby the roll bar is positioned outwardly of the wall or cabinet panel but a portion of an unused tissue roll disposed thereon will be positioned within the recessed portion of the fixture.

The use of premoistened wipes is also well known. Premoistened wipes are most commonly used in the cleaning of a child or infant after removing a soiled diaper. Such wipes are often provided in refillable plastic tubs. It is also known to provide premoistened wipes as a replacement for dry bathroom tissue.

SUMMARY OF THE INVENTION

The present inventors have recognized difficulties and problems inherent in the prior art and in response thereto have developed an improved mounting device for a dispenser. The mounting device may be used to support the dispenser on a conventional dry bathroom tissue fixture and the dispenser may be used to supply both dry bathroom tissue and premoistened wipes.

In one aspect, the present invention provides a mounting device comprising, i.e., including but not limited to, a positioning member, a first support member, a second support member and a linkage operatively disposed between at least one of the support members and the positioning member whereby movement of the positioning member causes relative motion between the first and second support members. The first support member has a first distal end and the second support member has a second distal end. The first distal end is moveable relative to said second distal end along a lateral axis whereby said first and second distal ends are engageable with the oppositely disposed recesses of a conventional bathroom tissue fixture.

In some embodiments, the invention may include a longitudinal guide slot in which the positioning member is disposed. A second linkage may also be used whereby a linkage is disposed between each of the support members and the positioning member. If a housing is used with the invention, the linkage members may be disposed within the housing. Latching mechanisms may also be used with the invention to inhibit the relative motion of the first and second support members.

In another aspect, the present invention provides a mounting device having a housing, a first support member, a second support member and an attachment mechanism. Each of the support members are partially disposed within the housing, are moveable relative to the housing, and are in supporting engagement with the housing. The first support member has a first distal end and the second support member has a second distal end. The first distal end is moveable relative to said second distal end along a lateral axis whereby said first and second distal ends are engageable with the oppositely disposed recesses of a conventional bathroom tissue fixture. The attachment mechanism attaches the mounting device to a dispenser.

The housing may include a first panel, a second panel and a hinge connecting the two panels. The housing may also have a longitudinal dimension and be configured whereby the lateral axis defined by the support members is asymmetrically located with respect to the longitudinal dimension of the housing.

The attachment mechanism may also be adapted to attach the mounting device to a dispenser in two different positions whereby the lateral axis has a different relative position with respect to the dispenser in the two different positions.

The attachment mechanism may include a threaded bore and a threaded fastener which is engageable with the threaded bore. The threaded fastener may also be selectively engageable with the housing at a first threaded opening and at a second threaded opening.

In yet another aspect, the present invention provides a mounting device having a housing, a first support member, a second support member, and a longitudinally extending engagement surface disposed on the housing. Each of the support members are partially disposed within the housing, are moveable relative to the housing, and are in supporting engagement with the housing. The first support member has a first distal end and the second support member has a second distal end. The first distal end is moveable relative to said second distal end along a lateral axis whereby said first and second distal ends are engageable with the oppositely disposed recesses of a conventional bathroom tissue fixture. The longitudinally extending engagement surface disposed on the housing is engageable with a dispenser.

The housing may also include a longitudinally extending guide slot. A positioning member operatively associated with the support members may be disposed in the guide slot. The longitudinally extending engagement surface, for engaging the dispenser, may be located on a projection disposed adjacent the guide slot.

One advantage provided by the present invention is that it provides an adjustable device which may be used with many different conventional bathroom tissue fixtures which have a pair of oppositely disposed recesses. Such a mounting device may be attached to a dispenser to thereby support the dispenser on a conventional bathroom tissue fixture.

Another advantage of the present invention is that the use of a housing or longitudinally extending engagement surface which is positioned asymmetrically with respect to the lateral axis defined by the support members allows the mounting device to support dispensers on a wider variety of different fixtures by providing greater flexibility in the relative positions of the lateral axis of the support members and the dispenser.

These and other advantages of the invention are provided by its various aspects, individually and in combinations thereof.

BRIEF DESCRIPTION OF THE DRAWINGS

The invention will be more fully understood and further advantages will become apparent when reference is made to the following description of the invention and the accompanying drawings, in which.

Figure 1:
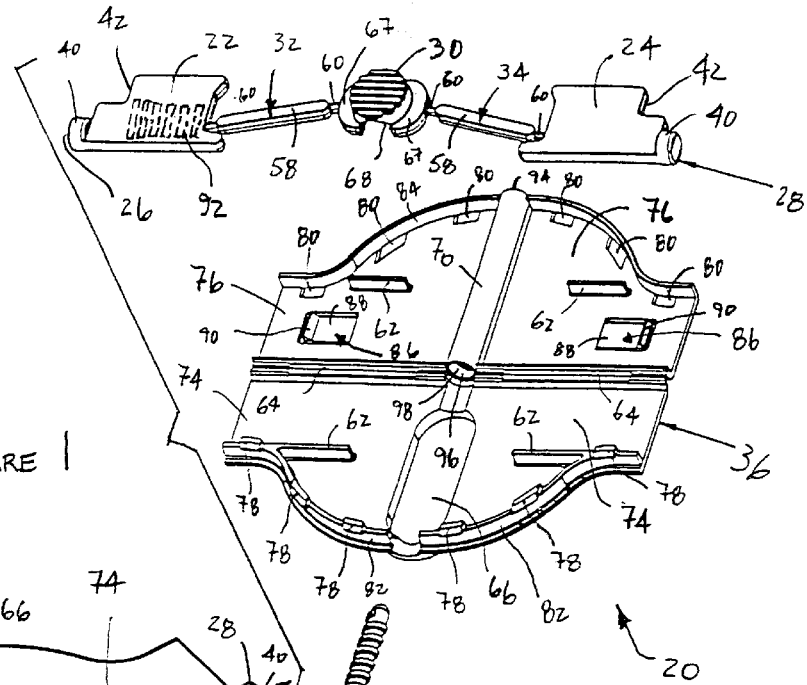
FIG. 1 is an exploded view of a mounting device in accordance with the present invention.

Corresponding reference characters indicate corresponding parts throughout the several views. The disclosed embodiments are set forth to illustrate and exemplify the invention. The disclosed embodiments are not intended to be an exhaustive illustration of the invention or to be construed as limiting the scope of the invention to the precise forms disclosed.

DESCRIPTION OF THE INVENTION

A mounting device 20 in accordance with the present invention may be used with a conventional bathroom tissue fixture as illustrated in the Figures. One embodiment of a mounting device 20 is illustrated in an exploded view in FIG. 1.

The mounting device 20 includes two support members 22 and 24 each of which includes a distal end 26 and 28. The support members 22, 24 are connected to a positioning member 30 by linkages 32 and 34. The support members 22, 24 are received within a housing 36. A threaded fastener 38 is used in the attachment of a dispenser to the mounting device 20.

Figure 4:
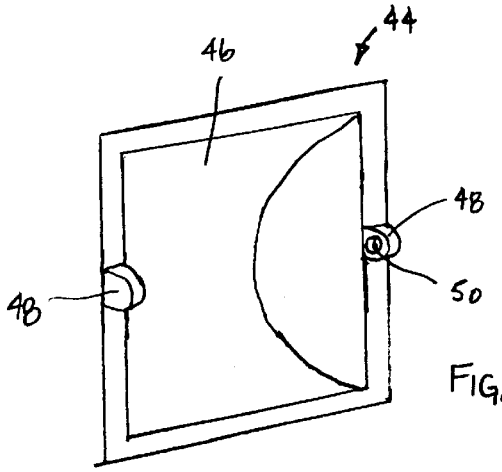
FIG. 4 is a perspective view of a conventional bathroom tissue fixture.
Figure 5:
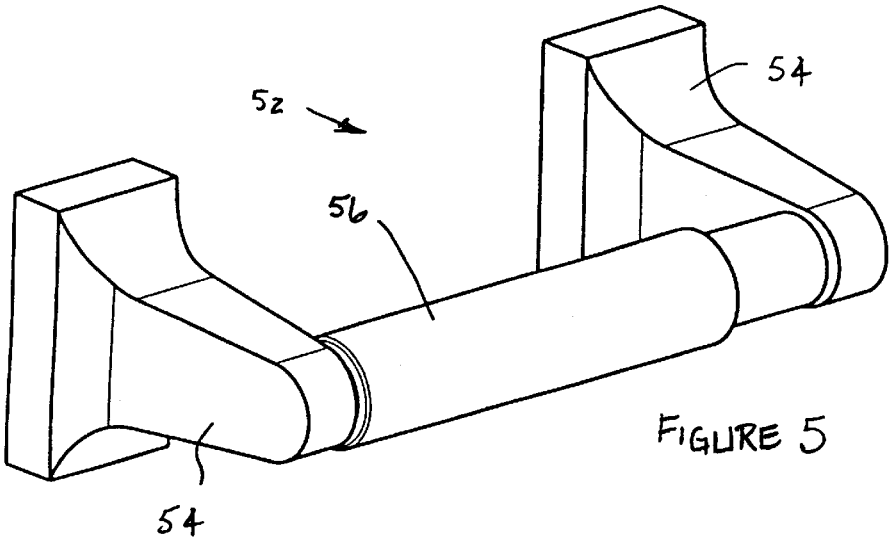
FIG. 5 is a perspective view of another conventional bathroom tissue fixture.

The mounting device 20 may be used with conventional bathroom tissue fixtures which are commonly found in residential and commercial buildings. FIGS. 4 and 5 show two examples of such conventional bathroom tissue fixtures. The fixture 44 illustrated in FIG. 4 has a recessed portion 46 and two short extensions 48 having a pair of oppositely disposed recesses 50 (only one is visible in FIG. 4) which may receive the ends of a conventional roll bar. The conventional fixture 52 shown in FIG. 5 includes two posts 54 which also include a pair of oppositely disposed recesses (not visible) for receiving the ends of a conventional telescoping roll bar 56.

Figure 3:
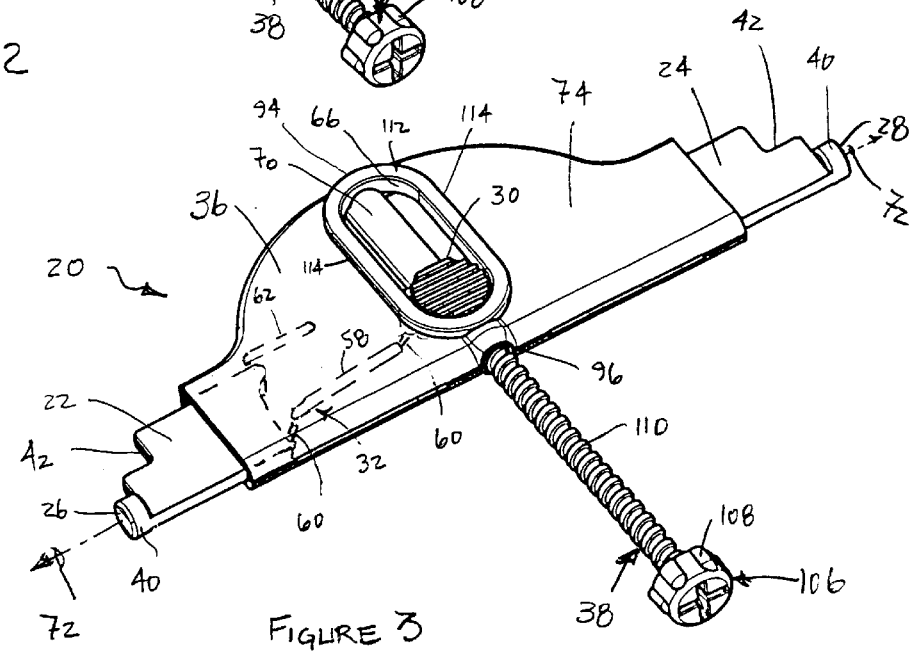
FIG. 3 is a perspective view of a mounting device with the support members in an extended position.
Figure 6:
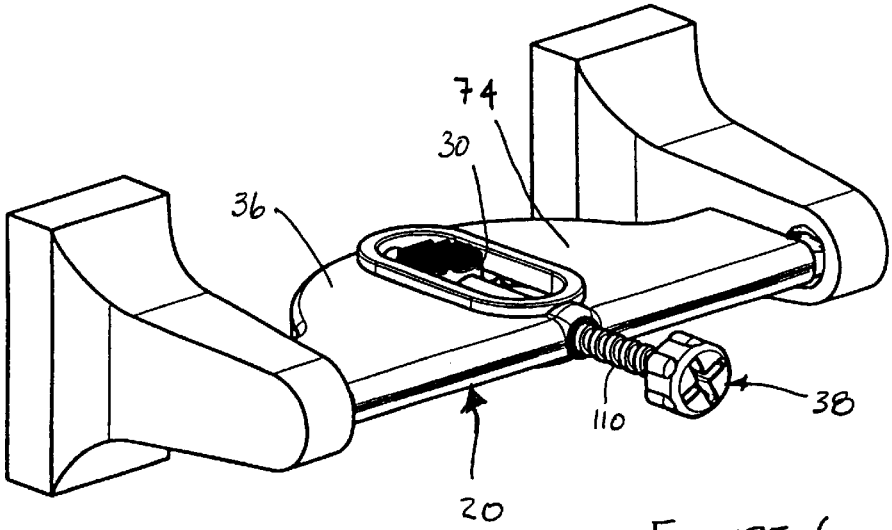
FIG. 6 is a perspective view of a mounting device engaged with a conventional bathroom tissue fixture.

As best seen in FIGS. 1 and 3, the distal ends 26, 28 of the support members 22, 24 are formed by cylindrical sections 40 and stepped portions 42. When the mounting device 20 is employed with conventional bathroom tissue fixtures, the distal ends 26, 28 are engaged with the pair of oppositely disposed recesses that would otherwise receive the opposite ends of a conventional roll bar. FIG. 6 illustrates a mounting device 20 with the distal ends 26, 28 of its support members 22, 24 engaged with the oppositely disposed recesses of a conventional bathroom tissue fixture.

The use of a relatively small cylindrical portion 40 and a stepped portion 42 to form the distal ends 26 and 28 allows the distal ends 26, 28 to be engaged with a variety of differently sized recesses or openings. For example, the small cylindrical portions 40 will fit into relatively small recesses while the distal segment of the stepped portion 42 from which the cylindrical portion 40 extends is sized to fit within the recesses of most conventional bathroom tissue fixtures. The use of such a graduated distal end allows the distal end to fit within both small and large recesses while also minimizing the potential for relative movement of the distal end within the recess.

Figure 2:
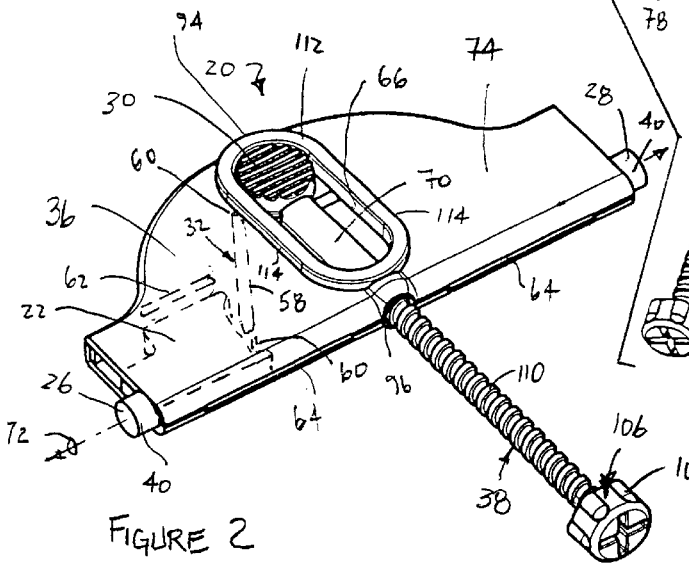
FIG. 2 is a perspective view of a mounting device with the support members in a retracted position.

The support arms 22, 24 of the embodiment illustrated in FIGS. 1–3 are connected with the positioning member 30 with linkages 32 and 34. The linkages each include a central rigid portion 58 and pivotal connections 60 linking the rigid portion 58 to the support arm and positioning member 30. In the assembled mounting device 20, the movement of support arms 22, 24 is constrained by guides 62 and hinges 64 which limit the support arms 22, 24 to lateral movement. The positioning member 30 is disposed within guide slot 66 which limits the positioning member 30 to longitudinal movement. The positioning member 30 also includes a groove 68 which is adapted to mate with a cylindrical portion 70. The cylindrical portion 70 extends longitudinally and is located centrally within guide slot 66 in the assembled mounting device 20. The cooperative engagement of positioning member 30 and cylindrical portion 70 also limits the positioning member 30 to longitudinal movement and prevents the rotation thereof.

In the assembled mounting device 20, a shoulder 67 along the outer perimeter of the positioning member 30 is positioned between opposing panels 74 and 76 of the housing. The reciprocal longitudinal movement of the positioning member 30 causes the support members 22 and 24 to move inwardly and outwardly in a lateral direction due to the action of linkages 32 and 34 and the constrainment of the support members 22, 24 between guides 62 and hinges 64. The movement of the positioning member 30 from the position illustrated in FIG. 2 to the position illustrated in FIG. 3 causes the support arms 22 and 24 to both move relatively outwardly. The distal ends move together with support arms 22 and 24 during such relative motion of support arms 22 and 24 and this relative movement of the distal ends 26 and 28 defines a lateral axis 72. By aligning the lateral axis 72 with the oppositely disposed recesses of a conventional bathroom tissue fixture and moving the positioning member 30, the distal ends 26 and 28 may be engaged with the recesses and the mounting device 20 may be mounted to the fixture as exemplified by FIG. 6.

Either guide slot 66 or the cooperative engagement of the groove 68 and cylindrical portion 70 could be used by itself as a guide to limit or control the movement of the positioning member 30. In the illustrated embodiment, both the guide slot 66 and cylindrical portion 70 act to limit the positioning member 30 to longitudinal movement which is angularly oriented to the lateral axis 72. The movement of the positioning member 30 may be advantageously oriented at a perpendicular angle to the lateral axis as shown in the illustrated embodiment.

Alternatively, a different configuration of support arms and linkages could be used whereby it would be desirable to have positioning member 30 move in a different direction relative to the lateral axis 72 to obtain the desired movement of the distal ends 26, 28. Still further alternative embodiments of the mounting device, such as that illustrated in FIGS. 11 and 12 and discussed below, may be used which do not rely upon a linkage to obtain the desired movement of the distal ends 26, 28.

As used herein, the term "linkage" refers to any part which interconnects two bodies whereby movement of one of the bodies causes the linkage to effectuate movement of the other body.

In the illustrated embodiment of mounting device 20, both support members 22 and 24 move relative to housing 36. In alternative embodiments, however, one of the support members could be affixed to the housing or formed integrally with the housing whereby only one of the support members would move relative to the housing. In such an embodiment, movement of the one support member would still result in relative movement between the two support members and the distal ends 26, 28 could be engaged and disengaged with a pair of oppositely disposed recesses.

The support arms 22, 24; linkages 32, 34; and positioning member 30 may be formed as a single integral unit. The support arms 22, 24, linkages 32, 34 and positioning member 30 may be advantageously formed by injection molding a polypropylene or acrylonitrile butadiene styrene (ABS) material. The housing 36 and threaded fastener may also be formed by injection molding a polypropylene or ABS material. Polycarbonate, polyethylene, acetal and other suitable materials may also be used. Those having ordinary skill in the art will recognize that these parts may be formed using a variety of alternative known materials and manufacturing techniques, e.g., machining.

The illustrated housing 36 includes two panels 74 and 76 which are connected by hinges 64. The housing also includes a plurality of projections 78 along the edge of one panel 74 which engage corresponding apertures 80 in the other panel 76. The projections 78 slightly overhang edge wall 82. Hinges 64 permit the two panels 74 and 76 to be pivoted relative to each other and allow projections 78 to mate with apertures 80. Projections 78 are biased inwardly as they are inserted through apertures 80 and snap resiliently outwardly after passage through apertures 80 to securely engage opposite edge wall 84 in a "snap-fit" and maintain the housing in a closed position.

When the illustrated mounting device 20 is assembled, the support members 22 and 24 are partially disposed within the housing 36 with the distal ends 26, 28 extending outwardly from the housing 36. In the illustrated device 20, the two linkages 32 and 34 are also located within the housing 36.

Figure 13:
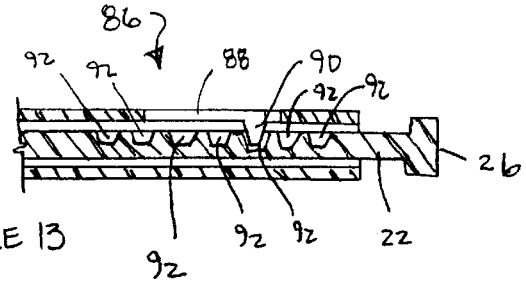
FIG. 13 is a cross sectional view of a latching mechanism.
Figure 14:
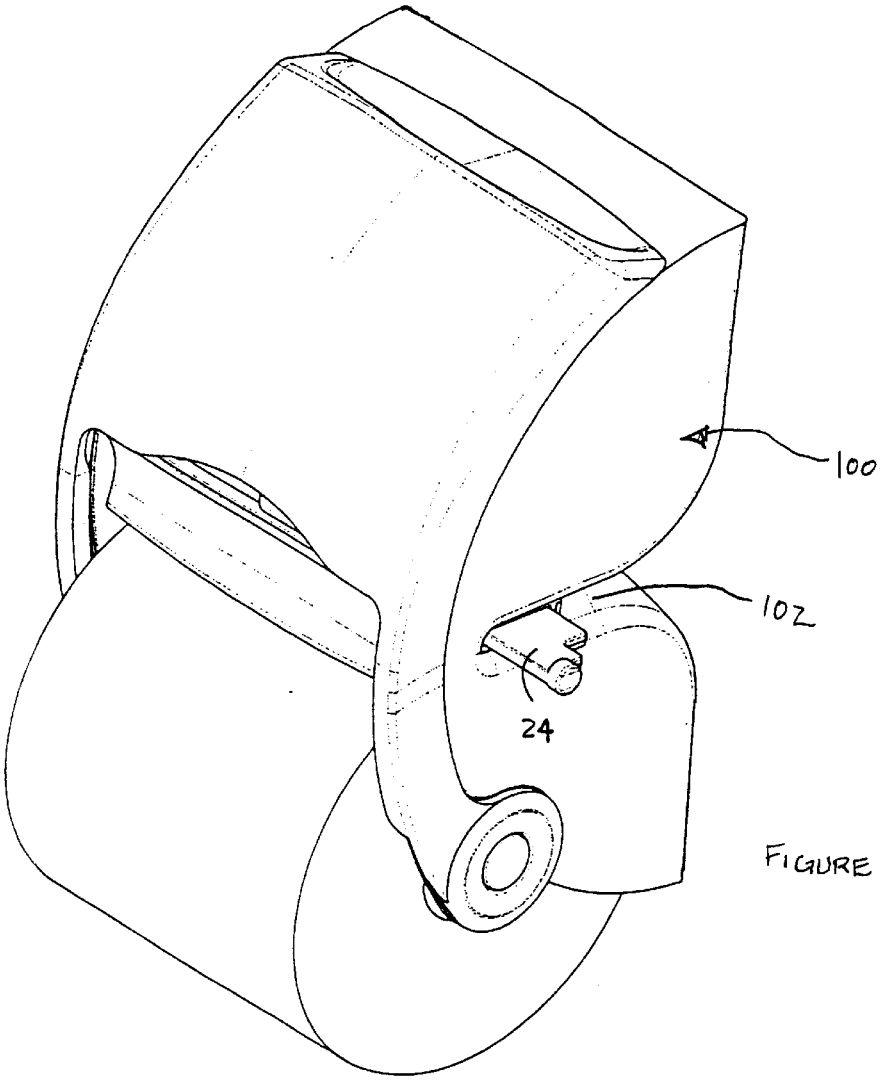
FIG. 14 is a perspective view of a mounting device and a dispenser.
Figure 15:
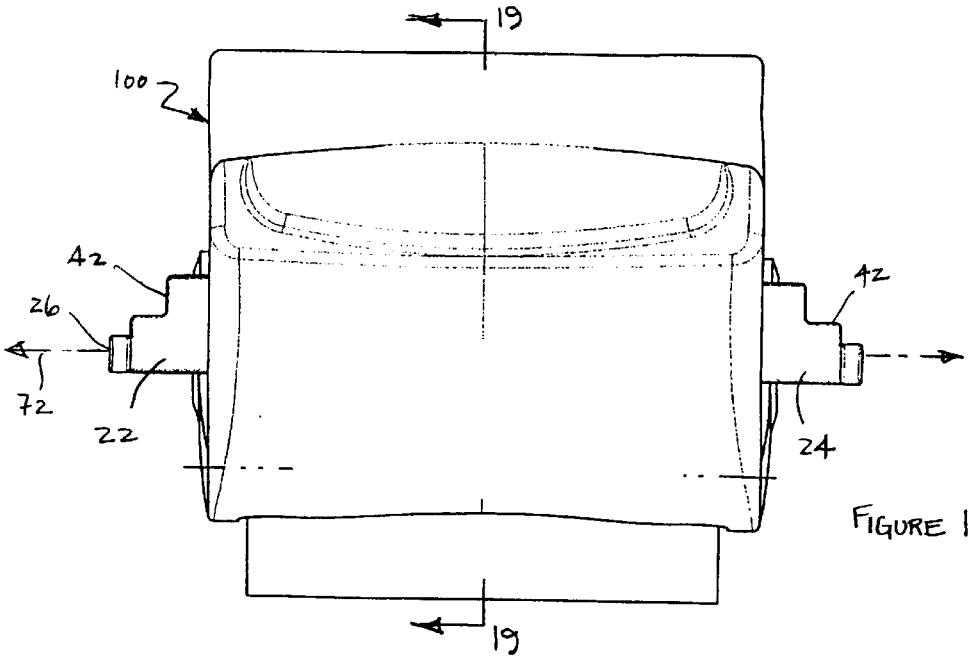
FIG. 15 is a top view of the mounting device and dispenser of FIG. 14.
Figure 17:
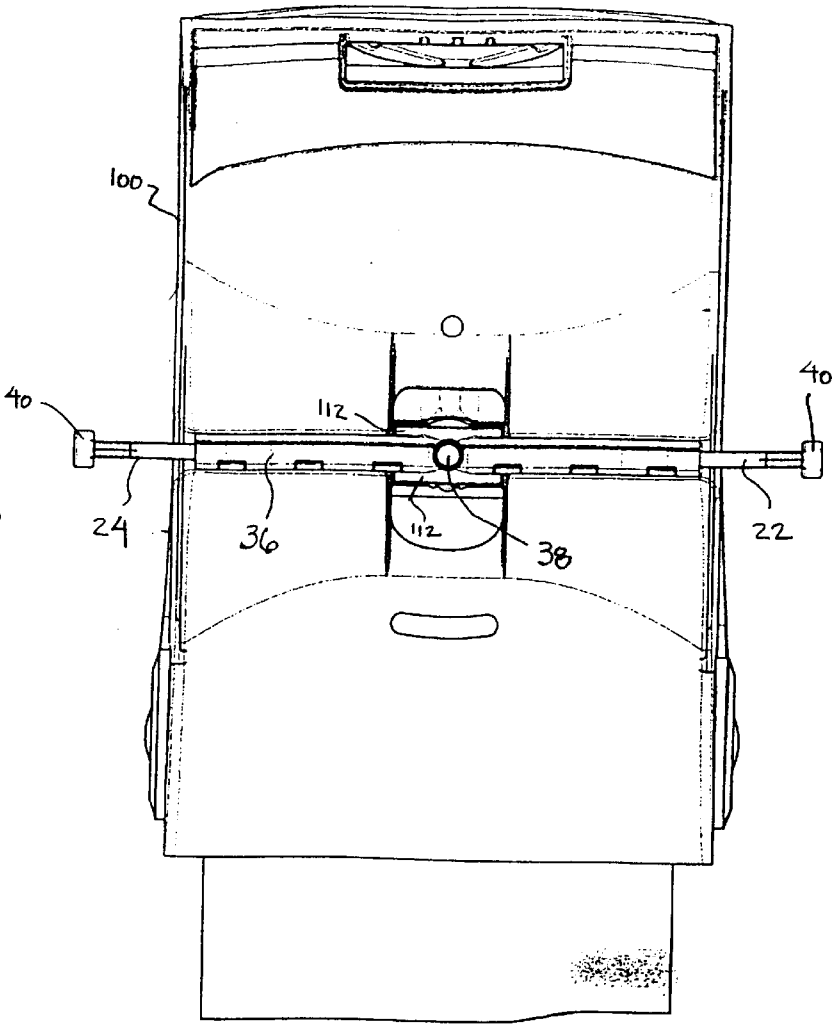
FIG. 17 is a rear view of the mounting device and dispenser of FIG. 14.
Figure 16:
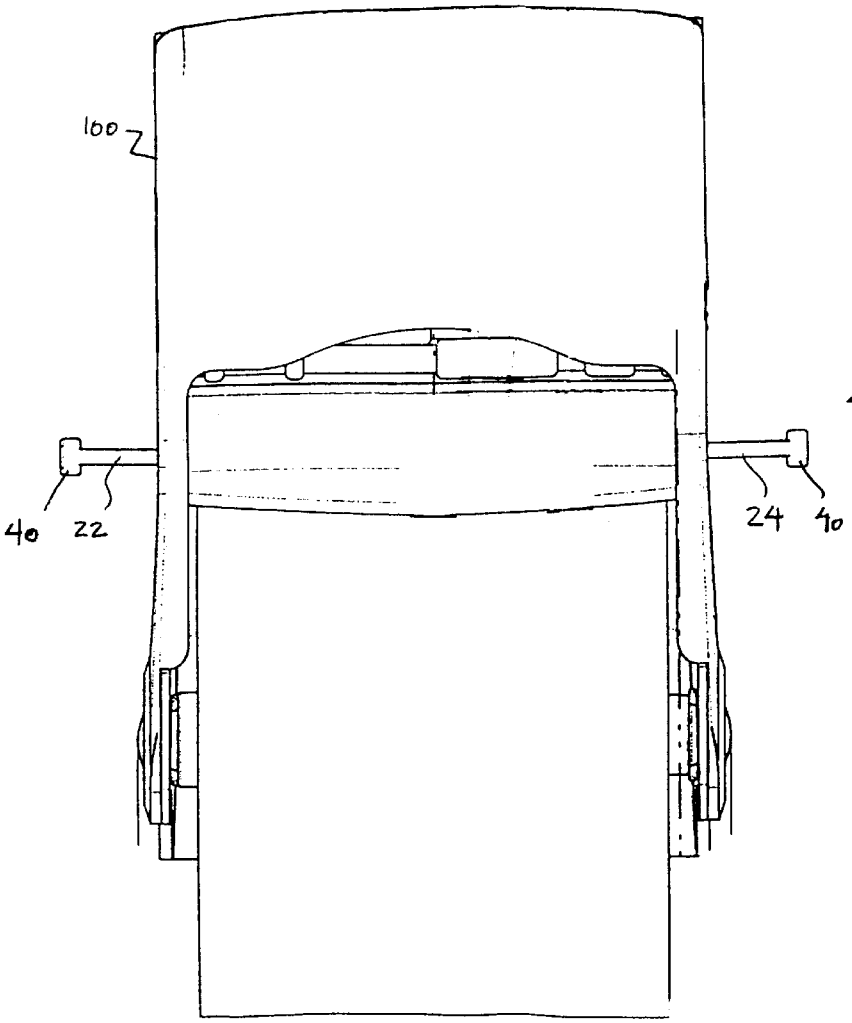
FIG. 16 is a front view of the mounting device and dispenser of FIG. 14.

The illustrated embodiment 20 also includes a latching mechanism 86. The illustrated latching mechanism 86 includes a resilient projecting arm 88 which includes an engagement tip 90 at its free end as best seen in FIG. 13. The engagement tip 90 moves toward and away from the adjacent support member 22, 24 as the tip 90 progressively engages a plurality of individual indentations 92 in the support member 22, 24 as the support member 22, 24 is moved along the lateral axis. In the embodiment illustrated in FIG. 1, the indentations 92 are located on the surface of the support members 22, 24 which are not shown, however, the location of the indentations 92 on support member 22 is illustrated with dashed lines.

By providing two latching mechanisms 86, each providing engagement between the housing 36 and one of the two support members 22, 24, the relative motion between the two support members 22, 24 may be inhibited by the engagement of the latching mechanisms 86 with the support members 22, 24. In alternative mounting devices, a single latching mechanism may be sufficient to inhibit the relative motion between support members 22, 24. For example, if one of the support members was not moveable relative to the housing, a single latching mechanism engaging the moveable support member to the housing would be sufficient to inhibit relative motion between the two support members. A single latching mechanism which directly engaged the two support members would also inhibit relative motion between the two support members 22, 24.

In the illustrated latching mechanism 86, the engagement and disengagement of the tip 90 with the individual indentations 92 does not require significant force, thereby readily allowing a user of the mounting device 20 to move the support arms 22, 24 inwardly and outwardly. The support arms 22, 24, however, may also be subjected to vibrational forces and movement relative to the fixture during use. Consequently, the inhibition of relative motion between the support arms 22, 24 by the engagement of the tip 90 with an individual indentation 92 inhibits the disengagement of the support arms with the opposed recesses 50 of a fixture after installation of the mounting device 20.

Alternative latching mechanisms 86 may also be employed to inhibit the relative motion between support members 22, 24. For example, a projecting tip located on the support member could engage corresponding indentations on the housing or the frictional engagement between a support member and the housing or the other support member could be sufficiently high to inhibit the relative movement between the support members 22, 24.

The illustrated housing 36 also includes an attachment mechanism formed by threaded bore 98 and threaded fastener 38 which may be used to attach a dispenser to the housing 36. Alternative attachment mechanisms such as a "snap-fit" or a frictional engagement between the housing and dispenser may also be used to attach the mounting device to a dispenser or other object.

Suitable dispensers for use with the mounting devices of the present invention include dispensers adapted to provide both dry and premoistened wiping products. Examples of such dispensers are described in detail in commonly assigned U.S. Patent Applications entitled "Dispenser and Tray for Premoistened Wipes" and "Dispensing System and Method for Premoistened Wipes" having Ser. No. 09/302,282 and Ser. No. 09/302,281 both filed Apr. 30, 1999, the disclosures of which are hereby incorporated by reference. The disclosure of commonly assigned U.S. Provisional Patent Application entitled "Dispenser for Premoistened Wipes" and filed Apr. 30, 1999 is also hereby incorporated by reference.

In an installed condition, the illustrated support members 22, 24 supportingly engage the housing 36 which, in turn, is attached to or otherwise engages the dispenser 100 to thereby conveniently mount the dispenser 100 to a conventional bathroom tissue fixture. In alternative embodiments, the support members could directly support the dispenser.

Figure 9:
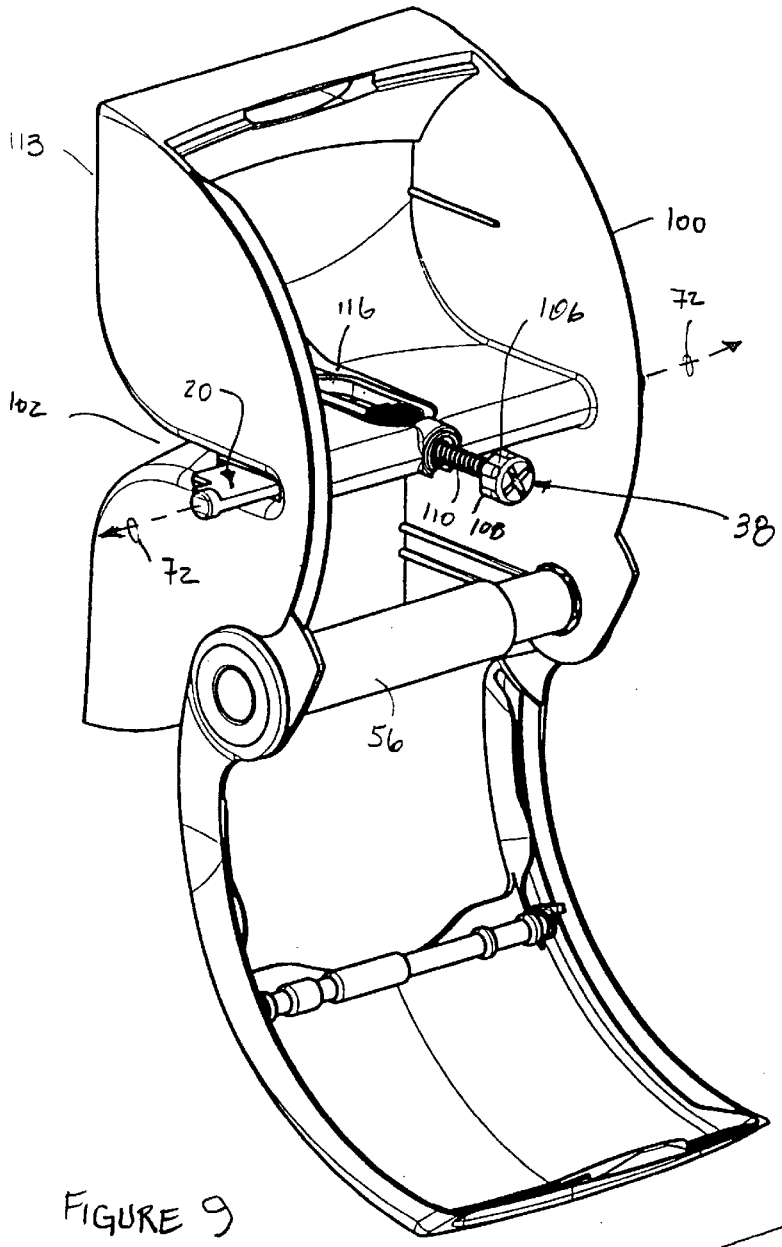
FIG. 9 is a perspective view of a mounting device and a dispenser.

The illustrated housing 36 includes two separate threaded openings 94 and 96. The threaded fastener 38 may be engaged with either opening 94 or 96. A single threaded bore 98 extends the entire length of cylindrical portion 70 to form both threaded openings 94 and 96, however, multiple threaded bores may also be used to provide a plurality of threaded openings for receiving a threaded fastener. As discussed below, the selection of which opening 94, 96 into which to insert the threaded fastener 38 may depend upon the fixture to which the mounting device is being secured. For example, if the fixture recessed into a wall or cabinet (FIG. 4) it may be advantageous orient the mounting device and dispenser so that the fastener 38 is inserted into opening 94 while if the fixture which extends outwardly (FIG. 5) it may be advantageous to insert the fastener 38 into opening 96 as shown in FIG. 9. The configuration of the dispenser 100 or other object being attached to the mounting device 20 may also influence the selection of which opening into which to insert fastener 38.

As can be seen in FIGS. 2 and 3, the assembled housing 36 has its largest longitudinal dimension extending from opening 94 to opening 96. The lateral axis 72 is asymmetrically positioned with respect to this longitudinal dimension of the housing. By asymmetrically positioning the lateral axis 72 defined by the distal ends 26, 28, the housing may be engaged to a dispenser 100 or other object at different locations on the housing to thereby allow the dispenser 100 to be mounted at different relative positions with respect to the lateral axis. This result may alternatively be achieved with a symmetrically placed lateral axis and asymmetrically located attachment locations. This ability facilitates the use of the mounting device 20 with a wide variety of different bathroom tissue fixtures. For example, by positioning the lateral axis 72 at different longitudinal locations along a slot 102 in the dispenser 100, a single mounting device 20 and dispenser 100 may be used with either a recessed fixture 44 or an outwardly extending fixture 52 to position the rear of the dispenser 100 flush with the wall or cabinet to which the fixture is mounted.

Figure 10:
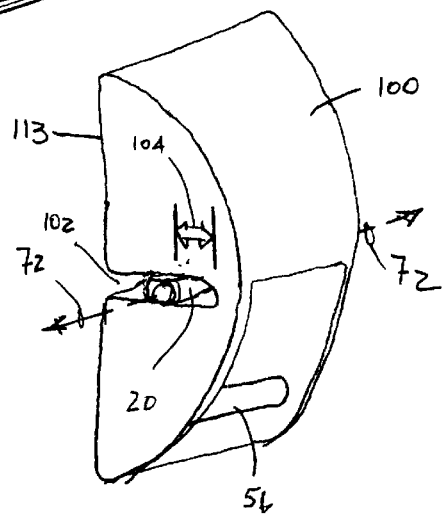
FIG. 10 is a perspective view of a mounting device and a dispenser.

As can be seen in FIGS. 9 and 10, by inserting the mounting device 20 into the dispenser slot 102 to varying degrees, the lateral axis 72 may be located at different relative positions with respect to the dispenser 100. The double arrow 104 (FIG. 10) shows the difference in longitudinal positions of the two lateral axis locations in FIGS. 9 and 10.

The threaded fastener 38 is shown in FIG. 9 prior to its engagement with the dispenser 100. To complete the attachment of the dispenser 100 to the mounting device 20, the threaded fastener 38 is turned until fastener head 106 engages the dispenser 100. As can be seen in FIG. 9, the fastener head 106 may include slots which permit the use of either a flat-head or a phillips head screwdriver. A relatively large fastener head 106 with ridges 108 on the outer perimeter thereof allows the fastener head 106 to be easily gripped and turned by the user's fingers and thereby permit the dispenser 100 to be attached without the use of tools. The use of threads 110 having a relatively large pitch, i.e., extending over a relatively long length of shaft per revolution, minimizes the number of times the fastener 38 must be turned during installation and thereby facilitates installation in the absence of tools. The tightening of the threaded fastener 38 to engage the dispenser 100 will cause the rear surface 113 of the dispenser 100 to engage the wall or cabinet panel disposed behind the dispenser 100.

The attachment mechanism may be adapted to permit the dispenser to be attached to the housing in different positions whereby the lateral axis has a different relative position with respect to the dispenser in at least two different positions. When the lateral axis is asymmetrically placed, this may further expand the different relative positions between the lateral axis and attached dispenser which are possible.

Figure 7:
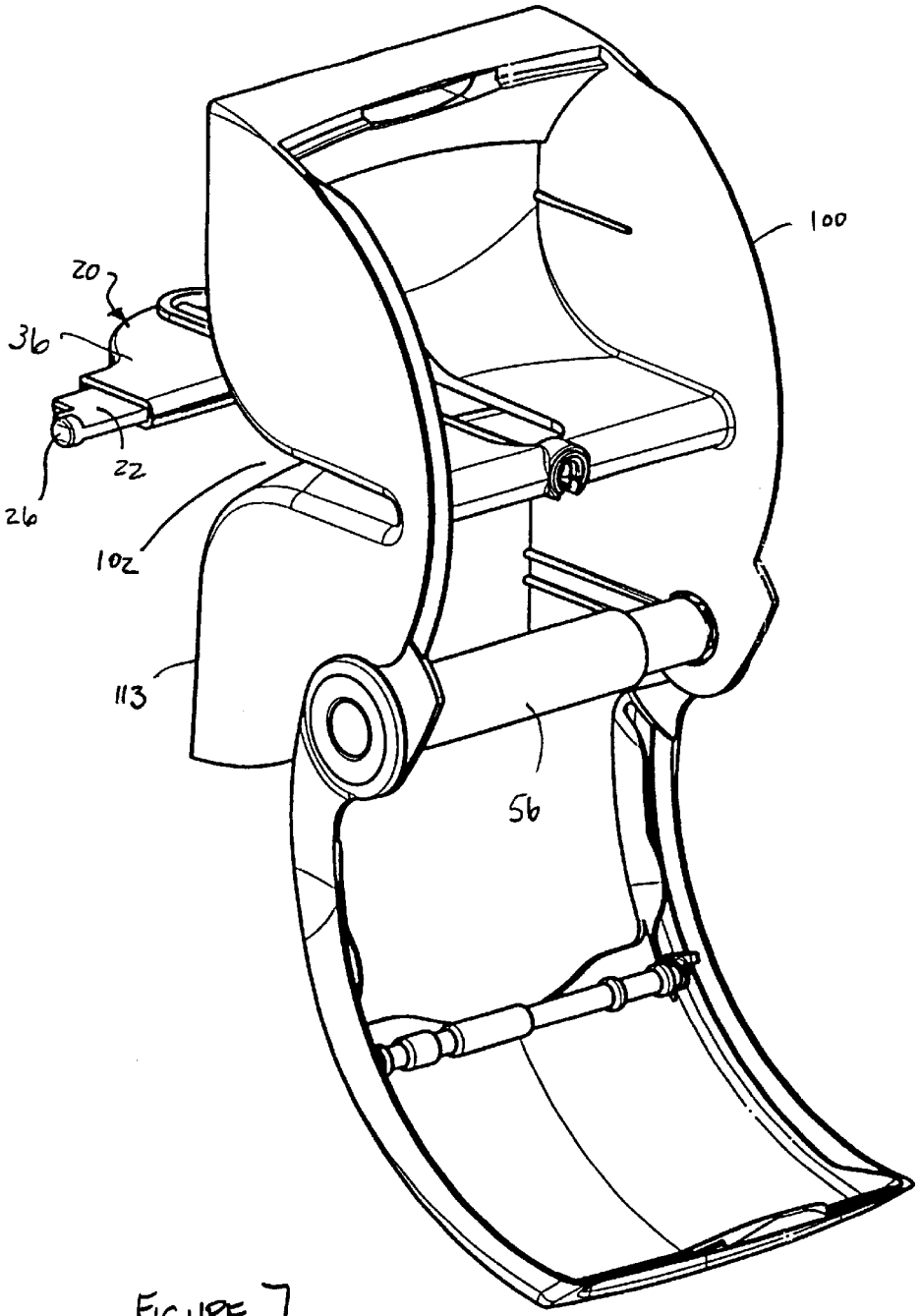
FIG. 7 is a perspective view of a mounting device prior and a dispenser prior to attachment.
Figure 8:
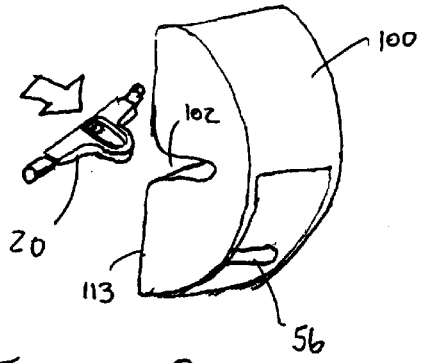
FIG. 8 is a perspective view of a mounting device and a dispenser prior to attachment.

For example, the use of illustrated mounting device 20 which slides into a slot 102 (FIGS. 7 and 8) and is thereby positionable at different locations within the slot permits the mounting device 20 and dispenser 100 to be securely attached at many different relative positions as the fastener 38 engages the dispenser and the dispenser engages the wall at various points along the slot for differently configured fixtures. Typically, the mounting device 20 will be attached to a conventional bathroom tissue fixture and then the dispenser 100 will be secured to the mounting device 20. The illustrated dispenser 100, however, allows access to positioning member 30 when the mounting device is positioned within slot 102 and the mounting device 20 and dispenser 100 may alternatively be attached together before securing the mounting device 20 to the fixture.

In the embodiment illustrated in FIGS. 9 and 10, the mounting device 20 is inserted into slot 102 in an orientation whereby the fastener 38 engages threaded opening 96. By turning the mounting device 20 and inserting the device 20 so that the threaded fastener 38 engages the threaded opening 94, the mounting device 20 and the lateral axis 72 may be located within a more rearward range of relative positions than the range available when the fastener engaged threaded opening 96.

Alternative methods may also be used to enable a mounting device to be attached to a dispenser or other object whereby the lateral axis 72 is located at different relative positions. For example, the dispenser could have a plurality of different openings through which the fastener 38 could be inserted or spacer or adapter components could be placed between the mounting device and the dispenser to selectively alter their relative positions.

Figure 19:
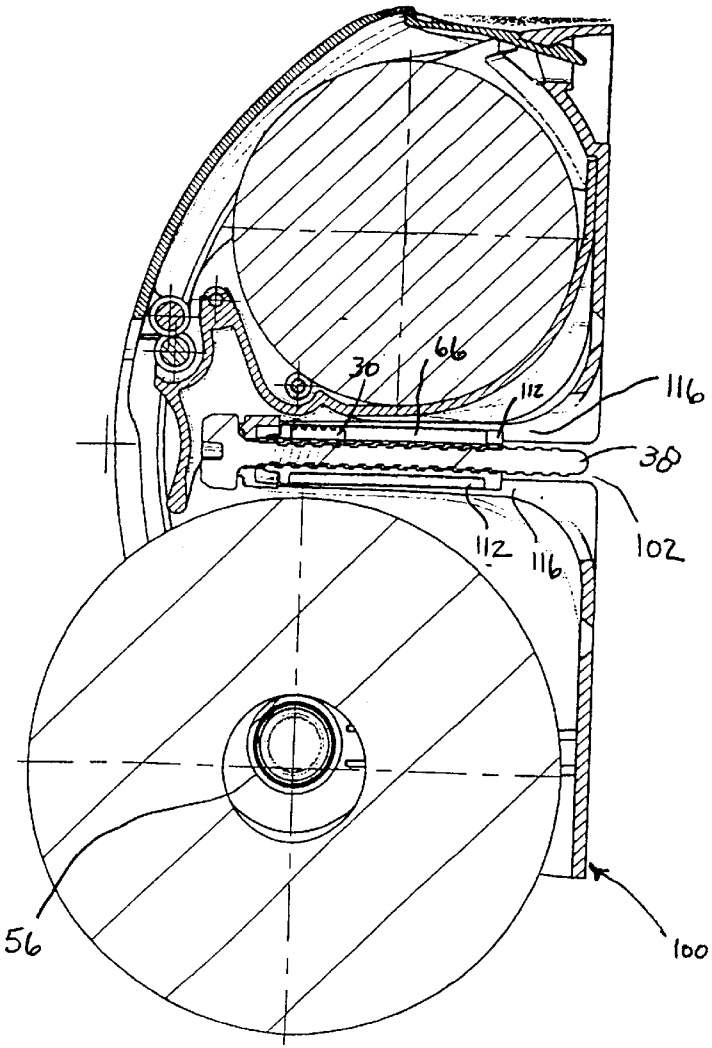
FIG. 19 is a cross sectional view taken along line 19—19 of FIG. 15.
Figure 18:
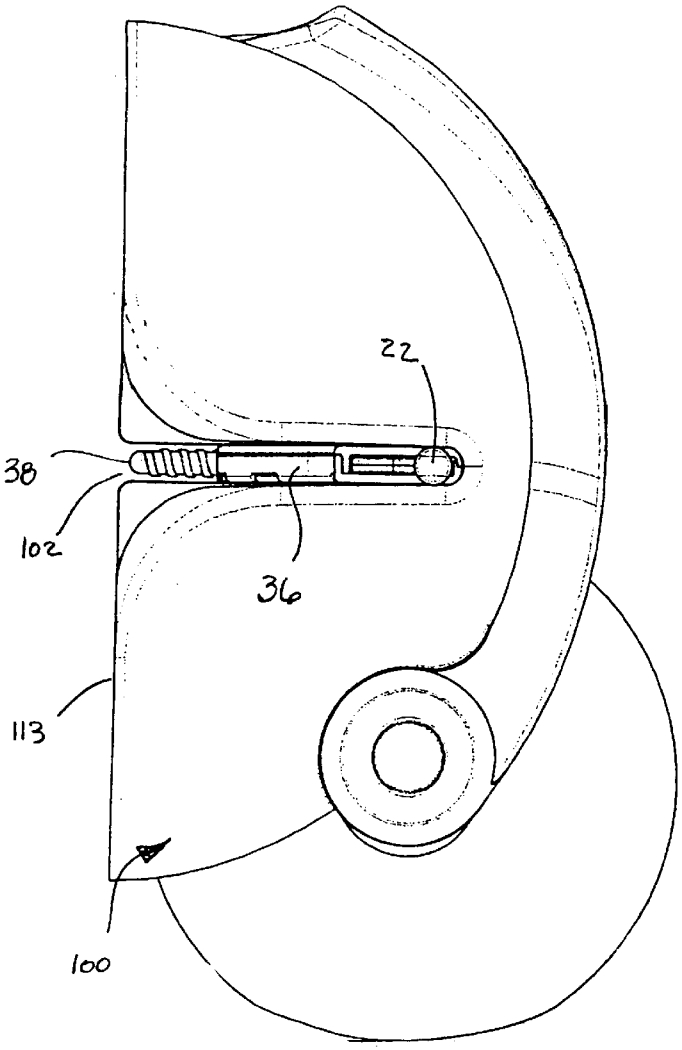
FIG. 18 is a side view of the mounting device and dispenser of FIG. 14.

A projection 112 located on the housing 36 (FIGS. 2 and 3) adjacent the guide slot 66 also facilitates the attachment of the mounting device 20 to the dispenser 100. In the embodiment illustrated in FIGS. 1–10, a racetrack shaped projection 112 is located on the exterior surface of both panel 74 and 76. The projection 112 on panel 76 is partially visible in FIG. 19 and is located directly opposite the projection 112 shown on panel 74.

The projections 112 include two longitudinally extending engagement surfaces 114 on the outer side surface of the projections 112. These outer engagement surfaces 114 engage the interior edge of slots 116 (FIGS. 9 and 19) in the dispenser 100 as the mounting device 20 is attached to the dispenser 100. The engagement of these surfaces facilitates the proper alignment of the mounting device 20 and the dispenser 100. The longitudinally extending engagement surfaces 114 have a longitudinal length which corresponds to the major longitudinal dimension of the housing 36. Thus, the lateral axis 72 is also positioned asymmetrically with respect to the illustrated engagement surfaces 114. This allows the engagement surfaces 114 to facilitate the alignment of the mounting device 20 and the dispenser 100 through the full range of possible attachment positions.

Figure 12:
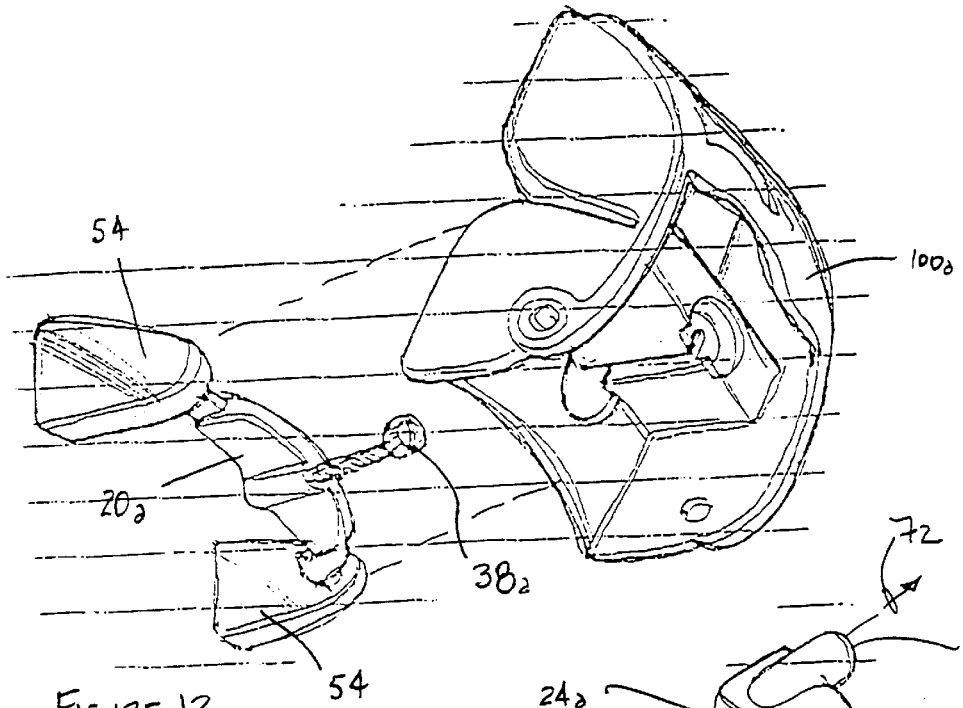
FIG. 12 is a perspective view of the mounting device of FIG. 11 attached to a conventional bathroom tissue fixture and a dispenser.
Figure 11:
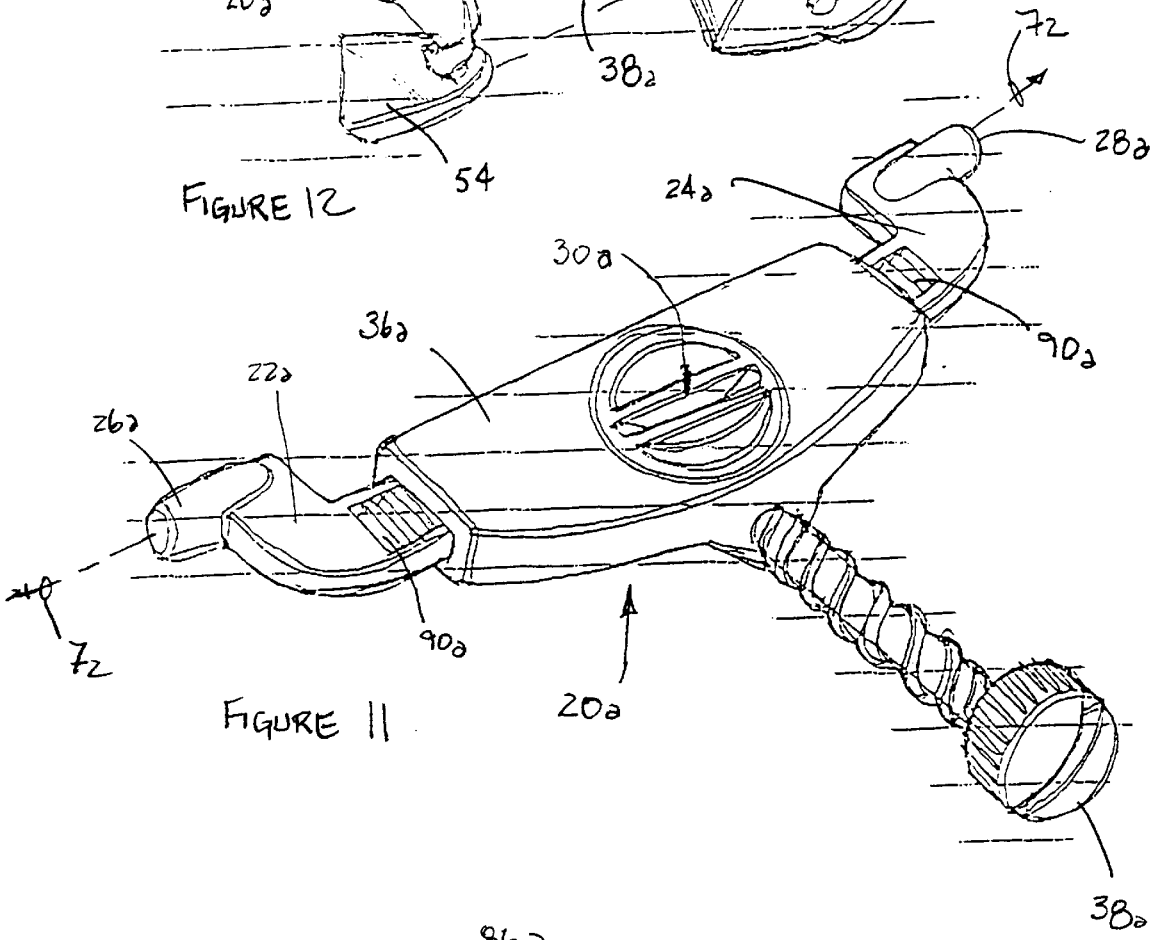
FIG. 11 is a view of an alternative embodiment of a mounting device.

In the alternative mounting device 20*a*, shown in FIGS. 11 and 12, the housing 36*a* and support arms 22*a*, 24*a* have a different configuration. The lateral axis 72 is still defined by the relative movement of distal ends 26*a* and 28*a*. The most significant difference between the mounting device 20 illustrated in FIG. 1 and the mounting device 20*a* illustrated in FIG. 11 is that the mounting device 20*a* of FIG. 11 does not include a linkage 32 or 34 or a longitudinally reciprocable positioning member 30. Instead, a rotatable member such as member 30*a* could be used to engage and move the support arms 22*a*, 24*a* of mounting device 20*a* in manner similar to a rack and pinion gear. The mounting device 20*a* could also include a latching mechanism to prevent the inadvertent movement of the support arms 22*a*, 24*a*.

As can be seen in FIG. 12, the mounting device 20*a* may be secured to a conventional bathroom tissue fixture and a dispenser 100*a* attached thereto in a manner which is similar to that described above for mounting device 20 and dispenser 100.

While this invention has been described in detail, it will be readily apparent to a person of ordinary skill in the art that various changes and modifications can be made without departing from the spirit and general principles of the invention. All of such changes and modifications are contemplated as being within the scope of the present invention as defined by the subjoined claims. Furthermore, this application is intended to cover such departures from the present disclosure as come within known or customary practice in the art.

What is claimed is:

1. An adjustable mounting device for a conventional bathroom tissue fixture having a pair of oppositely disposed recesses, said mounting device comprising:

a positioning member;

a first support member and a second support member, said first support member having a first distal end and said second support member having a second distal end, said first distal end being moveable relative to said second distal end along a lateral axis whereby said first and second distal ends are engageable with the oppositely disposed recesses by relative motion between said first and second support members; and a linkage operatively disposed between at least one of said support members and said positioning member whereby movement of said positioning member causes said relative motion between said first and second support members.

2. The adjustable mounting device of claim 1 wherein said positioning member is reciprocably moveable along a longitudinal axis angularly oriented to said lateral axis.

3. The adjustable mounting device of claim 1 further comprising a second linkage whereby one of said linkages is operatively disposed between each of said support members and said positioning member.

4. The adjustable mounting device of claim 1 further comprising a latching mechanism operably engageable with one of said first and second support members whereby said latching mechanism, when engaged, inhibits relative motion between said first and second support members.

5. The adjustable mounting device of claim 1 further comprising a housing, said first and second support members being partially disposed within said housing and said first and second distal ends extending outwardly from said housing.

6. The adjustable mounting device of claim 5 wherein said housing further comprises an attachment mechanism whereby a dispenser is attachable to said housing.

7. The adjustable mounting device of claim 6 wherein said attachment mechanism comprises a threaded bore and a threaded fastener for engaging said threaded bore.

8. The adjustable mounting device of claim 5 wherein said housing includes a longitudinally extending guide slot, said positioning member disposed within said guide slot.

9. The adjustable mounting device of claim 5 further comprising a second linkage whereby one of said linkages is operatively disposed between each of said support members and said positioning member and said linkages are disposed within said housing.

10. The adjustable mounting device of claim 9 further comprising first and second latching mechanisms operably engaging said first and second support members respectively with said housing whereby said latching mechanisms, when engaged, inhibit relative motion between said first and second support members.

11. The adjustable mounting device of claim 1 further comprising a housing, said housing having a guide for controlling the movement of said positioning member.

12. The adjustable mounting device of claim 11 wherein said linkage is disposed within said housing.

13. The adjustable mounting device of claim 1 further comprising a housing, said first and second support members being partially disposed within said housing and said first and second distal ends extending outwardly from said housing, said at least one of said support members being moveable relative to said housing; and a latching mechanism operably engaging said housing with said at least one of said support members whereby said latching mechanism, when engaged, inhibits movement of said at least one of said support members and said housing.

14. An adjustable mounting device for mounting a dispenser to a conventional bathroom tissue fixture having a pair of oppositely disposed recesses, said mounting device comprising:

a housing;

a first support member and a second support member, each of said support members being partially disposed within said housing, movable relative to said housing, and in supporting engagement with said housing, said first support member having a first distal end and said second support member having a second distal end, said first distal end being movable relative to said second distal end along a lateral axis whereby said first and second distal ends are engageable with the oppositely disposed recesses by relative motion between said first and second support members; and an attachment mechanism connected to the housing adapted to attaching the dispenser to said housing wherein said attachment mechanism comprises a threaded bore and a threaded fastener engageable with said threaded bore.

15. The mounting device of claim 14 wherein said housing comprises a first panel and a second panel and a hinge connecting said first and second panels, said support members being partially disposed between said first and second panels.

16. The mounting device of claim 14 further comprising a positioning member operatively associated with at least one of said support members whereby movement of said positioning member causes relative movement between said first and second support members.

17. The mounting device of claim 14 further comprising a positioning member operatively associated with each of said support members whereby movement of said positioning member causes relative movement between said first and second support members.

18. The mounting device of claim 17 wherein said positioning member is operatively associated with each of said support members with a linkage.

19. The mounting device of claim 17 wherein said positioning member is rotationally moveable.

20. The mounting device of claim 14 further comprising a latching mechanism operably engaging said first support member with said housing whereby said latching mechanism, when engaged, inhibits relative motion between said first support member and said housing.

21. The mounting device of claim 14 further comprising first and second latching mechanisms operably engaging said first and second support members respectively with said housing whereby said latching mechanisms, when engaged, inhibit relative motion between said first and second support members.

22. The mounting device of claim 14 wherein said housing has a longitudinal dimension and said lateral axis is asymmetrically positioned with respect to said longitudinal dimension of said housing.

23. The mounting device of claim 14 wherein said attachment mechanism is adapted to attach the dispenser to the housing in at least two different positions whereby said lateral axis has a different relative position with respect to the dispenser in said two different positions.

24. The mounting device of claim 14 wherein said attachment mechanism comprises a threaded fastener selectively engageable with said housing at a first threaded opening and at a second threaded opening.

25. An adjustable mounting device for mounting a dispense to a conventional bathroom tissue fixture having a pair of oppositely disposed recesses, said mounting device comprising:

a housing having a projection; and a first support member and a second support member, each of said support members being partially disposed within said housing, movable relative to said housing, and in supporting engagement with said housing, said first support member having a first distal end and said second support member having a second distal end, said first distal end being movable relative to said second distal end along a lateral axis whereby said first and second distal ends may be engaged and disengaged from the oppositely disposed recesses by relative motion between said first and second support members wherein said housing further comprises a longitudinally extending engagement surface engageable with the dispenser.

26. The mounting device of claim 25 further comprising a positioning member operatively associated with at least one of said support members whereby movement of said positioning member causes relative movement between said first and second support members.

27. The mounting device of claim 26 wherein said housing includes a longitudinally extending guide slot, said positioning member disposed within said guide slot, and said projection disposed adjacent said guide slot, and a longitudinally extending engagement surface disposed on said projection.

28. The mounting device of claim 26 wherein said positioning member is operatively associated with each of said support members with a linkage, said linkages being disposed within said housing.

29. The mounting device of claim 25 further comprising a longitudinally extending threaded bore and a threaded fastener engageable with said threaded bore.

30. The mounting device of 25 wherein said longitudinally extending engagement surface has a longitudinal length and said lateral axis is asymmetrically positioned with respect to said longitudinal length.

* * * * *